US006283105B1

(12) United States Patent
Kasai

(10) Patent No.: US 6,283,105 B1
(45) Date of Patent: Sep. 4, 2001

(54) SINGLE-CYLINDER 4-CYCLE ENGINE

(75) Inventor: Akihito Kasai, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/461,720

(22) Filed: Dec. 16, 1999

(30) Foreign Application Priority Data

Dec. 17, 1998 (JP) ..... 10-359529

(51) Int. Cl.[7] ..... F02D 41/00
(52) U.S. Cl. ..... 123/672; 123/478
(58) Field of Search ..... 123/672, 436, 123/679, 434, 478, 480

(56) References Cited

U.S. PATENT DOCUMENTS 4,401,079 * 8/1983 Aoki et al. ..... 123/435
4,515,131 * 5/1985 Suzuki et al. ..... 123/491
5,148,369 * 9/1992 Uchinami et al. ..... 123/672
5,566,663 * 10/1996 Hamburg et al. ..... 123/679
5,628,299 * 5/1997 Marzonia et al. ..... 123/672
5,722,372 * 3/1998 Hosoe et al. ..... 123/438

* cited by examiner

*Primary Examiner*—Henry C. Yuen
*Assistant Examiner*—Mahmoud Gimie
(74) *Attorney, Agent, or Firm*—Arent Fox Kintner Plotkin & Kahn

(57) ABSTRACT

In a single-cylinder 4-cycle engine including an oxygen concentration sensor provided at a location upstream of an exhaust emission control catalyst, the influence of pulsation of the exhaust gas is eliminated to enhance the detection accuracy by detecting of the concentration of oxygen in the exhaust gas. A first pulse generator generates a pair of pulse signals a and b per one rotation of a crankshaft, and a second pulse generator generates pulse signals c and d at every very small angle of rotation of the crankshaft. The angular speed of the crankshaft is detected from the interval of the pulse signals c and d. The pulse signal output a when the angular speed is smaller is determined as being the output during a compression stroke, and is used as an ignition signal $a_1$. The pulse signal output a when the angular speed is larger is determined as being the output during an exhaust stroke, and is used as an oxygen concentration detecting signal $a_2$.

4 Claims, 5 Drawing Sheets

SINGLE-CYLINDER 4-CYCLE ENGINE

BACKGROUND OF THE INVENTION

1. Field of the Invention

The present invention relates to a single-cylinder 4-cycle engine including a control means for feedback-controlling the amount of fuel supplied, based on a signal from an oxygen concentration sensor for detecting a concentration of oxygen in an exhaust gas. The concentration sensor is provided between an exhaust port and an exhaust emission control catalyst.

2. Description of the Prior Art

In an engine including an exhaust emission control catalyst of a noble metal such as platinum-rhodium and the like, disposed in an exhaust passage, to convert harmful components in an exhaust gas, it is a conventional practice to detect the concentration of oxygen in the exhaust gas with an oxygen concentration sensor provided in the exhaust passage at a location upstream of the exhaust emission control catalyst, to maximize the performance of the exhaust emission control catalyst, and to control the air-fuel ratio of an air-fuel mixture supplied to the engine in a range near a theoretical air-fuel ratio, based on the detected concentration of oxygen.

In a multi-cylinder engine in which the exhaust gas is discharged in sequence from a plurality of cylinders at every predetermined crank angle, the pulsation of the flow of exhaust gas in an exhaust passage is suppressed to a relatively small level. However, in a single-cylinder 4-cycle engine in which the exhaust stroke occurs only one time per two rotations of a crankshaft, a large pulsation may be produced in the flow of exhaust gas in the exhaust passage, and the exhaust gas passing through the exhaust emission control catalyst, may flow backwards in the exhaust passage due to the pulsation in some cases. The exhaust emission control catalyst has the effect of oxidizing the exhaust gas and for this reason, the concentration of oxygen in the exhaust gas flowing backwards from the exhaust emission control catalyst is deviated from an intrinsic value. If the false concentration of oxygen is detected for feedback-control of the amount of fuel supplied, there is a possibility that proper control cannot be carried out. Particularly, it is a recent tendency to position the exhaust port and the exhaust emission control catalyst at a smaller distance spaced apart from each other, in order to activate the exhaust emission control catalyst and provide compactness of the engine. Therefore, the distance between the exhaust emission control catalyst and the oxygen concentration sensor is also smaller, wherein the pulsation of the exhaust gas is liable to exert an influence.

SUMMARY OF THE INVENTION

The present invention has been accomplished with the above circumstance in view, and it is an object of the present invention to ensure that the concentration of oxygen in the exhaust gas can be detected without being influenced by the pulsation of the exhaust gas.

To achieve the above object, there is provided a single-cylinder 4-cycle engine comprising a control means for feedback-controlling the amount of fuel supplied, based on a signal from an oxygen concentration sensor for detecting the concentration of oxygen in an exhaust gas, which is provided between an exhaust port and an exhaust emission control catalyst, wherein the control means controls the amount of fuel supplied in a feedback manner based on the concentration of oxygen detected during an exhaust stroke.

With the above arrangement, when the exhaust gas is discharged during the exhaust stroke of the engine, the concentration of oxygen in the exhaust gas is detected by the oxygen concentration sensor. Therefore, it is possible to prevent the mis-detection of the concentration of oxygen in the oxidized exhaust gas flowing backwards from the exhaust emission control catalyst due to the pulsation of the exhaust gas, and to accurately feedback-control the amount of fuel supplied, based on the properly detected concentration of oxygen in the exhaust gas. Moreover, it is difficult to receive the influence of the pulsation of the exhaust gas and hence, the exhaust emission control catalyst can be disposed at a location near the exhaust port, whereby the exhaust gas having a high temperature can be supplied to the exhaust emission control catalyst, leading to an enhanced effect of purifying the exhaust gas, and the compactness of the engine can be achieved.

In addition, the control means includes a stroke discriminating means for discriminating an exhaust stroke and a compression stroke, and controls the amount of fuel supplied in a feedback manner based on the concentration of oxygen during the exhaust stroke determined by the stroke discriminating means.

With the above arrangement, the exhaust and compression strokes are discriminated by the stroke discriminating means provided in the control means. Therefore, it is possible to reliably discriminate the exhaust and compression strokes in which the crankshaft assumes the same phase.

Further, the stroke discriminating means detects the angular speed of a crankshaft of the engine and determines the exhaust stroke, when the detected angular speed is larger.

With the above arrangement, it is possible to reliably discriminate the exhaust stroke from the compression stroke because the angular speed of the crankshaft is larger during the exhaust stroke and smaller during the compression stroke.

Further, the time required for one rotation of the crankshaft is detected, and the stroke discriminating means determines the exhaust stroke when the detected time is shorter.

With the above arrangement, it is possible to reliably discriminate the exhaust stroke from the compression stroke considering that the time required for one rotation of the crankshaft is smaller for one rotation of the crankshaft including the exhaust stroke and larger for one rotation of the crankshaft including the compression stroke.

In addition, the stroke discriminating means determines the exhaust stroke, based on the phase of a cam shaft which drives one of an intake valve and an exhaust valve of the engine.

With the above arrangement, the exhaust stroke occurs only one time per one rotation of the cam shaft and hence, it is possible to reliably determine the exhaust stroke, based on the phase of the cam shaft.

BRIEF DESCRIPTION OF THE DRAWINGS

Embodiments of the present invention will now be described with reference to the accompanying drawings.

FIG. 1 a vertical sectional view of a single-cylinder 4-cycle engine.

FIG. 2 is a view showing first and second pulse generators in mounted states.

FIG. 3 is a view taken along a line 3—3 in FIG. 2.

FIG. 4 a diagram for explaining the pulse output of the first pulse generator.

FIG. 5 is a timing chart for indicating a technique for discriminating an exhaust stroke.

DETAILED DESCRIPTION OF PREFERRED EMBODIMENTS

Figure 1:
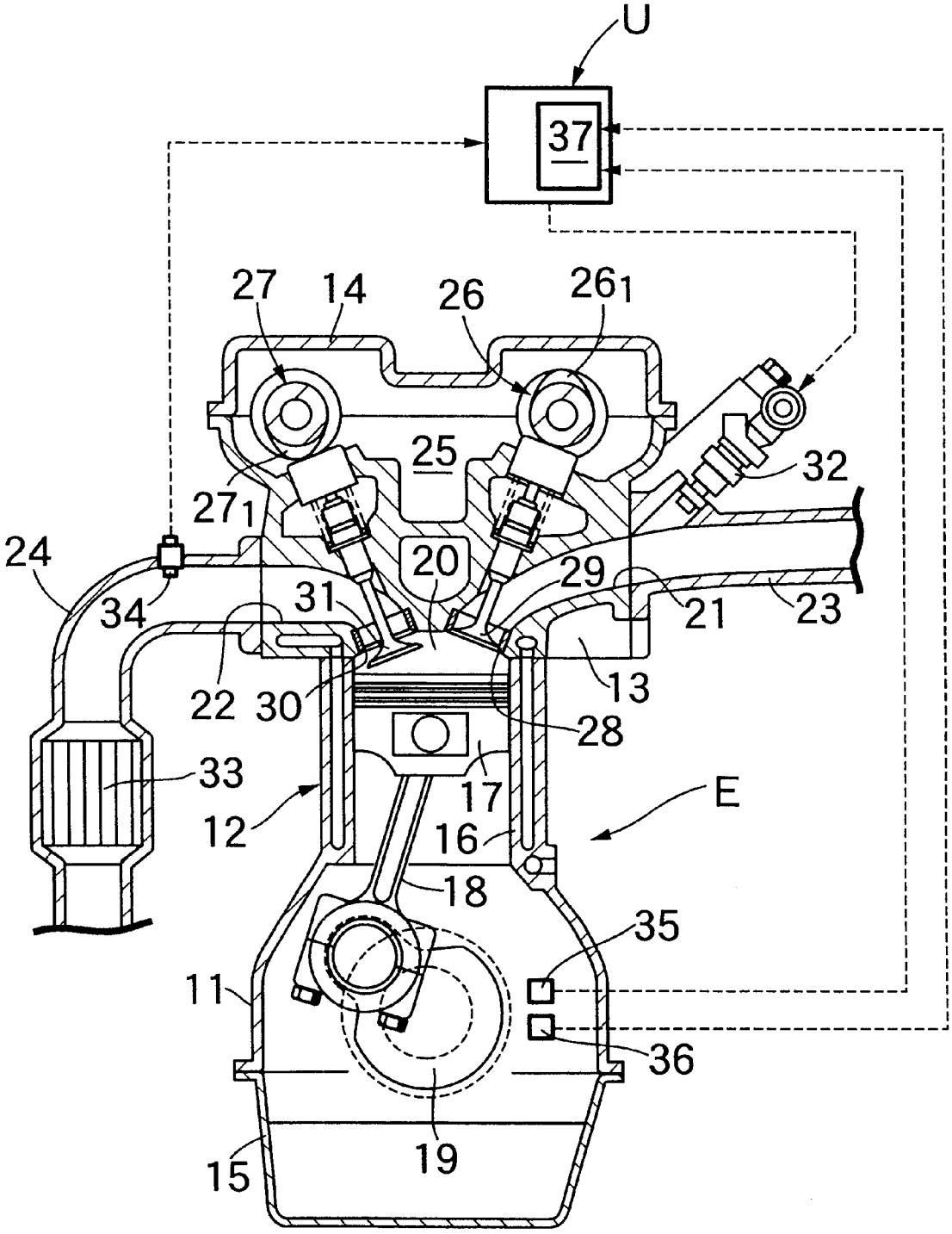
FIGS. 1 to 5 show an embodiment of the present invention.

As shown in FIG. 1, a single-cylinder 4-cycle engine E includes a cylinder block 12 integrally provided with a crankcase 11, a cylinder head 13 coupled to an upper surface of the cylinder block 12, a head cover 14 coupled to an upper surface of the cylinder head 13, and an oil pan 15 coupled to a lower surface of the crankcase 11. A piston 17 is slidably received in a cylinder 16 defined in the cylinder block 12, and is connected to a crankshaft 19 through a connecting rod 18. Defined in the cylinder head 13 are a combustion chamber 20 facing a top surface of the piston 17, and an intake port 21 and an exhaust port 22 connected to the combustion chamber 20. An intake pipe 23 is connected to the intake port 21, and an exhaust pipe 24 is connected to the exhaust port 22. An intake cam $\mathbf{26}_1$ rotated by an intake cam shaft 26, and an exhaust cam $\mathbf{27}_1$ rotated by an exhaust cam shaft 27, are positioned in a valve operating chamber 25. An intake valve 29 for opening and closing an intake valve bore 28 is driven by the intake cam $\mathbf{26}_1$, and an exhaust valve 31 for opening and closing an exhaust valve bore 30 is driven by the exhaust cam $\mathbf{27}_1$.

A fuel injecting valve 32 for injecting fuel into the intake port 21, is mounted in the intake pipe 23. An exhaust emission control catalyst 33 for purifying an exhaust gas, is provided in the exhaust pipe 24, and an oxygen concentration sensor 34 for detecting the concentration of oxygen in the exhaust gas, is mounted in the exhaust pipe 24 at a location upstream of the exhaust emission control catalyst 33. A first pulse generator 35 and a second pulse generator 36 for generating pulse signals in response to the rotation of the crankshaft 19, are mounted in the vicinity of the crankshaft 19 to determine that the engine E is in an exhaust stroke. An electronic control unit U functioning as a control means of the present invention, includes a stroke discriminating means 37, and controls the amount of fuel injected from the fuel injecting valve 32 in a feedback manner to regulate the air-fuel ratio of an air-fuel mixture, based on the concentration of oxygen in the exhaust gas detected by the oxygen concentration sensor 34, when the stroke discriminating means 37 has determined the exhaust stroke, based on the pulse signals from the first and second pulse generators 35 and 36.

In the single-cylinder 4-cycle engine E having an explosion stroke, an exhaust stroke, an intake stroke and a compression stroke which are conducted while the crankshaft 19 is rotated two rotations, the exhaust gas is discharged only during the exhaust stroke. Therefore, a pulsation may be produced in the flow in the exhaust gas within the exhaust pipe 24, whereby the exhaust gas passing through the exhaust emission control catalyst 33 may flow backwards within the exhaust pipe 24, towards the exhaust port 22, in some cases. The exhaust gas passing through the exhaust emission control catalyst 33 has a decreased concentration of oxygen due to the oxidizing effect of the exhaust emission control catalyst 33. Therefore, if the concentration of oxygen in the exhaust gas flowing backwards is detected by the oxygen concentration sensor 34 and used in the feedback control of the amount of fuel injected, there is a possibility that proper control may not be conducted. To overcome such problem, the concentration of oxygen in the exhaust gas may be detected when the exhaust gas within the exhaust pipe 24 has been discharged, namely, during the exhaust stroke (an actual exhaust stroke which does not include a valve-overlapping region). For this purpose, it is necessary to precisely determines the exhaust stroke.

An arrangement and operation for determining the exhaust stroke will be described below.

Figure 2:
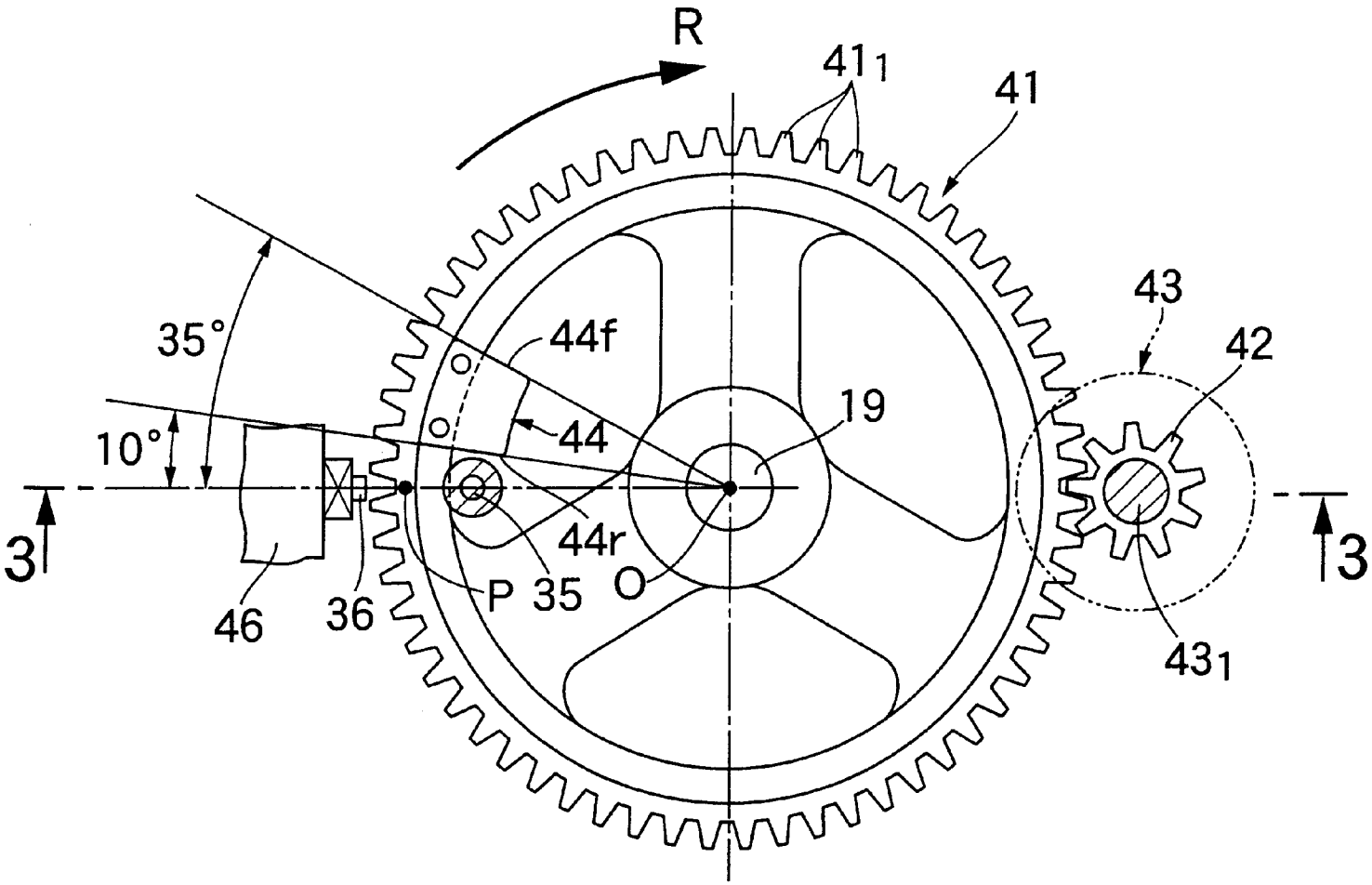
Figure 3:
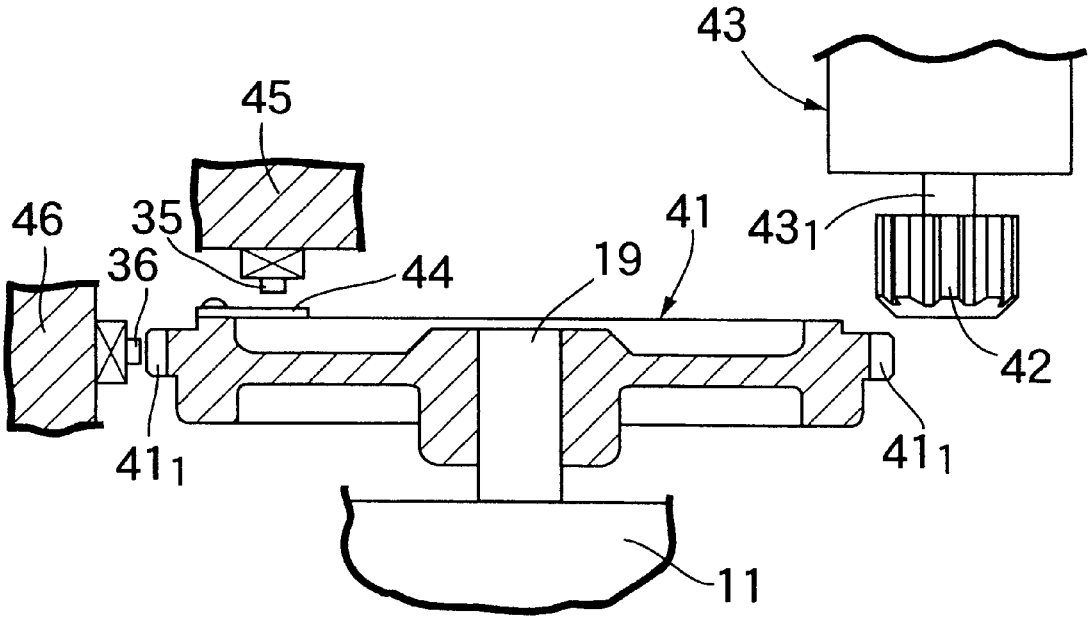

As shown in FIGS. 2 and 3, a flywheel 41 including a large number of teeth $\mathbf{41}_1$ on its outer periphery, is fixed to an end of the crankshaft 19. An output shaft $\mathbf{43}_1$ of a starter motor 43 having a pinion 42 integrally provided thereon, is capable of being advanced and retracted. If the starter motor 43 is driven at the start of the engine E, the output shaft is advanced, causing the pinion 42 to be meshed with the teeth $\mathbf{41}_1$ of the flywheel 41, whereby the crankshaft 19 is cranked.

A reluctor 44 is fixed to the outer periphery of one side of the flywheel 41, and the first pulse generator 35 is fixed to a fixing member 45, so that it is opposed to the reluctor 44. The second pulse generator 36 is fixed to a fixing member 46, so that it is opposed to the teeth $\mathbf{41}_1$ of the flywheel 41.

Figure 4:
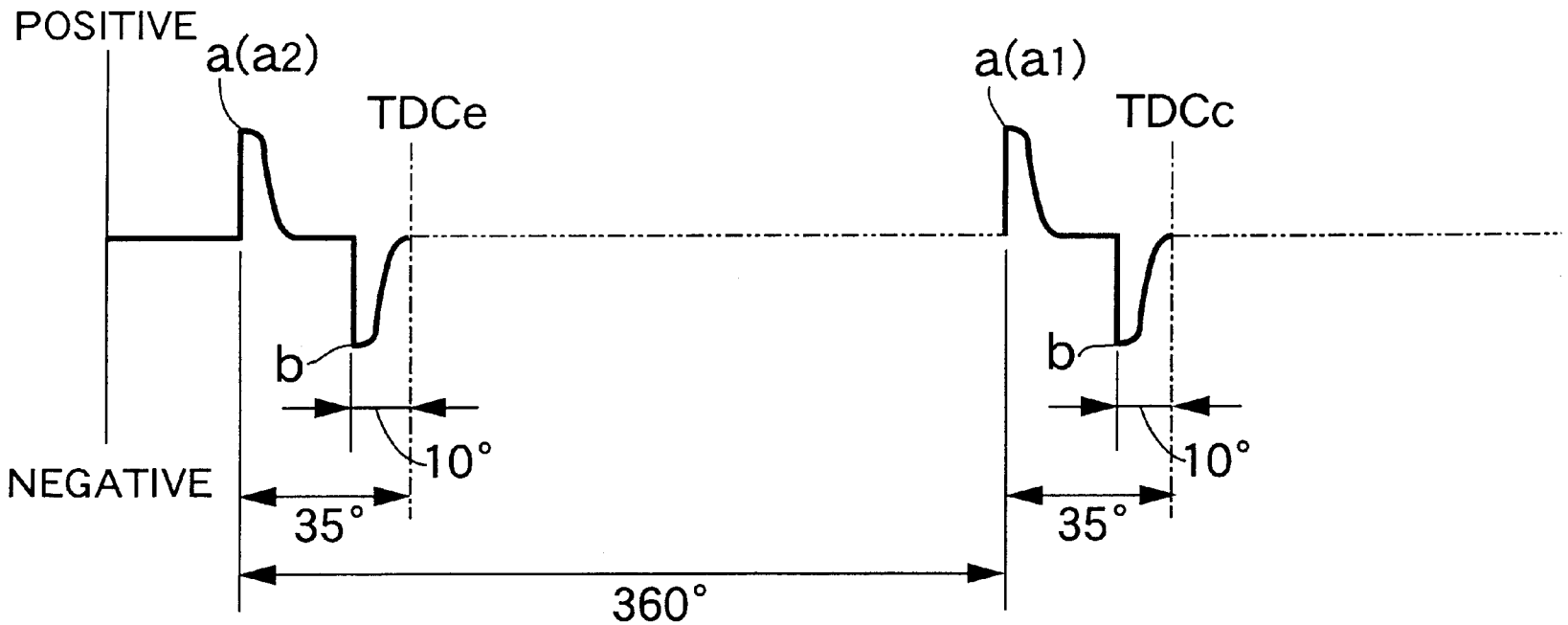

A technique for determining the exhaust stroke by the stroke discriminating means 37 of the electronic control unit U will be described with reference to FIGS. 4 and 5.

The direction of rotation of the crankshaft 19 and the flywheel 41 is indicated by an arrow R in FIG. 2. If the phase of the crankshaft 19 is at a top dead center TDCe at the end of the exhaust stroke or at a top dead center TDCc at the end of the compression stroke when a point P on the outer periphery of the flywheel 41 is opposed to the second pulse generator 36 (see FIG. 2), the position of mounting of the reluctor 44 is such that its front edge **44*f* as viewed in the rotational direction, forms an angle of 35° on the advanced side in the rotational direction R with respect to a line segment OP, and its rear edge 44*r* forms an angle of 10° on the advanced side in the rotational direction R with respect to a line segment OP. Therefore, as shown in FIG. 4, the first pulse generator 35 outputs positive polar pulse signals a at a location 35° short of the top dead center TDCe at the end of the exhaust stroke or the top dead center TDCc at the end of the compression stroke, and outputs a negative polar pulse signals 2** at a location 10° short of the top dead center TDCe at the end of the exhaust stroke or the top dead center TDCc at the end of the compression stroke.

Figure 5:
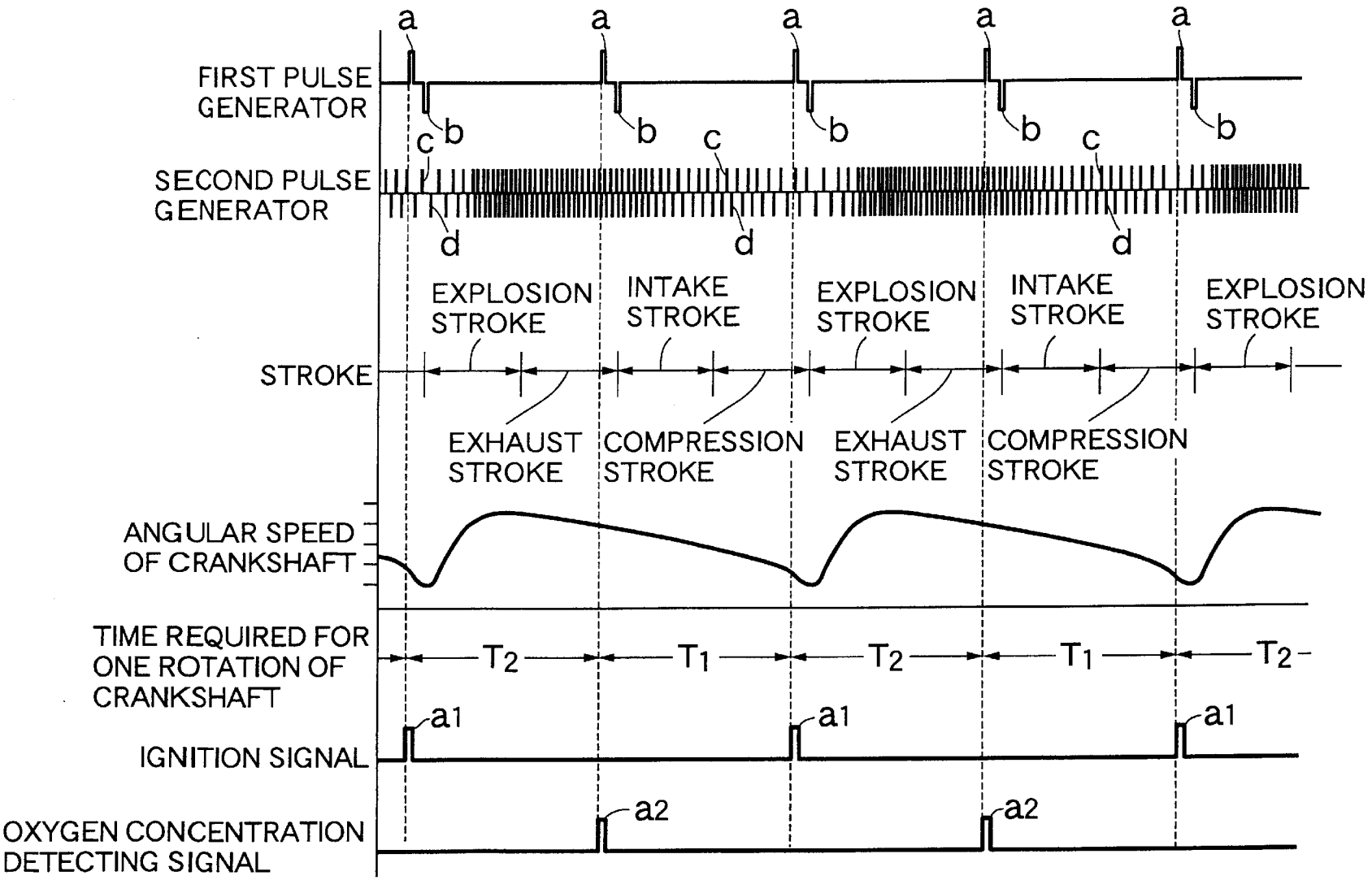

If the flywheel 41 has, for example, 120 teeth $\mathbf{41}_1$, the second pulse generator 36 outputs pairs of positive polar pulse signals c and negative polar pulse signals d, whenever the crankshaft 19 is rotated through 3° (see FIG. 5). Because the engine according to the present embodiment is of a single-cylinder type, the angular speed of the crankshaft 19 is varied at a period provided by a crank angle of 360°. More specifically, the angular speed assumes a maximum value at an end portion of the explosion stroke in which the piston 17 is driven by the pressure of the combustion gas, and the angular speed assumes a minimum value at an end portion of the compression stroke in which the piston 17 receives the compression load. Therefore, the interval of outputting of the positive polar pulse signals c and negative polar pulse signals d is not uniform, so that it is shorter in an area where the angular speed of the crankshaft 19 is larger, and it is longer in an area where the angular speed of the crankshaft 19 is smaller.

The explosion, exhaust, intake and compression strokes of the engine are conducted while the crankshaft 19 is rotated through two rotations. Therefore, the exhaust stroke and the compression stroke cannot be discriminated only by detecting the phase of the crankshaft 19 from the pulse signals generated by the first pulse generator 35. This is because both of the pulse signal in the compression stroke and the pulse signal in the exhaust stroke are included in the pulse signals generated by the first pulse generator 35 by the front edge 44*f* of the reluctor 44.

Therefore, the angular speed of the crankshaft 19 is detected based on the time interval between the positive polar pulse signals c and the negative polar pulse signals d generated by the teeth $\mathbf{41}_1$ of the flywheel 41 detected by the second pulse generator 36. The time interval is inversely proportional to the angular speed of the crankshaft 19. Therefore, when the time interval is smaller, the angular speed of the crankshaft 19 is larger, and when the time interval is larger, the angular speed of the crankshaft 19 is smaller. Then, among the positive polar pulses a generated by the front edge 44*f* of the reluctor 44, those generated when the angular speed of the crankshaft 19 is smaller (the compression stroke), are discriminated and employed as ignition signals $a_1$, and those generated when the angular speed of the crankshaft 19 is larger (the exhaust stroke), are discriminated and employed as oxygen concentration detecting signals $a_2$.

Thus, if the timing of detection of the concentration of oxygen in the exhaust gas by the oxygen concentration sensor 34 is controlled based on the timing of outputting of the oxygen concentration detecting signals $a_2$, the concentration of oxygen in the exhaust gas discharged during the exhaust stroke can be detected to properly control the amount of fuel injected. The gas to be detected by the oxygen concentration sensor 34 is difficult to be influenced by the pulsation of the exhaust gas and hence, the exhaust emission control catalyst 33 and the oxygen concentration sensor 34 can be placed in the proximity to the exhaust port 22. Thus, the exhaust gas having a high temperature can be supplied to the exhaust emission control catalyst 33, leading to an enhanced exhaust emission control effect, and moreover, the engine E can be made compact.

A second embodiment of the present invention will now be described.

In the above-described first embodiment, the stroke discriminating means 37 discriminates the exhaust stroke and the compression stroke, based on the angular speed of the crankshaft 19. In the second embodiment, however, the exhaust stroke and the compression stroke are discriminated based on the time required for one rotation of the crankshaft 19.

As can be seen from FIG. 5, the explosion and exhaust strokes, in which the angular speed of the crankshaft 19 is larger, are included in one rotation of the crankshaft 19 from the ignition signal $a_1$ to the oxygen concentration detecting signal $a_2$. Therefore, the time $T_2$ required for one rotation of the crankshaft 19 is relatively short. On the other hand, the intake and compression strokes, in which the angular speed of the crankshaft 19 is smaller, are included in one rotation of the crankshaft 19 from the oxygen concentration detecting signal $a_2$ to the ignition signal $a_1$. Therefore, the time $T_1$ required for one rotation of the crankshaft 19 is relatively long.

Therefore, if the times $T_1$ and $T_2$ are measured, it can be determined that the positive polar pulse signals a output at the end of the longer time $T_1$ are the ignition signals $a_1$, and the positive polar pulse signals a output at the end of the shorter time $T_2$ are the oxygen concentration detecting signals $a_2$.

According to the second embodiment, the same first and second pulse generators 35 and 36 as in the first embodiment can be used, and the same function and effect as in the first embodiment can be provided.

A third embodiment of the present invention will now be described.

In the above-described first and second embodiments, the means for discriminating the exhaust and compression strokes is required, resulting in a complicated structure, because the phase of the crankshaft 19 is detected. To solve this problem, the phase of the intake cam shaft 26 or the exhaust cam shaft 27 rotated in one rotation per two rotations of the crankshaft 19, may be detected by a means such as a pulse generator.

For example, if the exhaust cam shaft 27 is taken as an example, the exhaust stroke occurs during a time when the exhaust cam shaft 27 is rotated in one rotation. Therefore, if a concentration of oxygen in an exhaust gas is detected with the oxygen concentration sensor 34 upon the detection of the exhaust stroke based on the phase of the exhaust cam shaft 27, the concentration of oxygen in the exhaust gas discharged at the exhaust stroke can be detected to properly control the amount of fuel injected.

According to the third embodiment, the exhaust stroke can be discriminated by provision of only a single pulse generator, which can contribute to a reduction in the number of parts.

In the above-described embodiments, the timing of detection of the concentration of oxygen at the exhaust stroke is established at the location 35° short of the top dead center TDCe at the end of the exhaust stroke. Alternatively, the timing may be established at any location during the actual exhaust stroke. In the embodiments, the common first pulse generator 35 is used for the detection of the ignition timing and the oxygen concentration detecting timing, but an exclusive pulse generator can be used to detect the oxygen concentration detecting timing.

As discussed above, the concentration of oxygen in the exhaust gas is detected by the oxygen concentration sensor, when the engine is in the exhaust stroke and the exhaust gas is discharged. Therefore, it is possible to prevent the misdetection of the concentration of oxygen in the oxidized exhaust gas flowing backwards from the exhaust emission control catalyst due to the pulsation of the exhaust gas, and to accurately feedback-control the amount of fuel supplied, based on the properly detected concentration of oxygen in the exhaust gas. Moreover, it is difficult to receive the influence of the pulsation of the exhaust gas and hence, the exhaust emission control catalyst can be disposed at a location near the exhaust port. Thus, the exhaust gas having a high temperature can be supplied to the exhaust emission control catalyst, leading to an enhanced effect of purifying the exhaust gas, and compactness of the engine can also be achieved.

The exhaust stroke and the compression stroke are discriminated by the stroke discriminating means provided in the control means. Therefore, the exhaust stroke and the compression stroke can be reliably discriminated even though the crankshaft assumes the same phase.

It is possible to reliably discriminate the exhaust stroke from the compression stroke because the angular speed of the crankshaft is larger during the exhaust stroke and smaller during the compression stroke.

It is also possible to reliably discriminate the exhaust stroke from the compression stroke because the time required for one rotation of the crankshaft is smaller for one rotation of the crankshaft including the exhaust stroke and larger for one rotation of the crankshaft including the compression stroke.

The exhaust stroke is conducted only one time per one rotation of the crankshaft, and hence, it is possible to reliably discriminate the exhaust stroke based on the phase of the cam shaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A single-cylinder 4-cycle engine comprising an engine having an exhaust port, an exhaust emission control catalyst for purifying the exhaust gas, an oxygen concentration sensor positioned between said exhaust port and said exhaust emission control catalyst, for detecting the oxygen concentration in the exhaust gas, and control means, coupled to said oxygen concentration sensor, for feedback-controlling the amount of fuel supplied to the engine based upon the output of said oxygen concentration sensor during the exhaust stroke of said engine, wherein said control means includes a stroke discriminating means for discriminating the exhaust stroke and the compression stroke of said engine, and said control means controls the amount of fuel supplied based on the concentration of oxygen detected during the exhaust stroke discriminated by said stroke discriminating means.

2. A single-cylinder 4-cycle engine according to claim 1, wherein said stroke discriminating means detects the angular speed of the crankshaft of the engine and determines the exhaust stroke, when the detected angular speed is larger than the angular speed of the compression stroke.

3. A single-cylinder 4-cycle engine according to claim 1, wherein said stroke discriminating means detects the time required for one rotation of the engine crankshaft and determines the exhaust stroke, when the detected time is shorter than the time detected for the compression stroke.

4. A single-cylinder 4-cycle engine according to claim 1, wherein said stroke discriminating means determines the exhaust stroke, based on the phase of the engine cam shaft for driving one of an intake valve and an exhaust valve of the engine.

* * * * *